US007055692B2

(12) United States Patent
Waga et al.

(10) Patent No.: US 7,055,692 B2
(45) Date of Patent: Jun. 6, 2006

(54) PACKAGING BODY

(75) Inventors: Katsuhiro Waga, Osaka (JP); Shozo Omori, Koshigaya (JP)

(73) Assignee: Santen Pharmaceutical Co., Ltd., Osaka (JP)

( * ) Notice: Subject to any disclaimer, the term of this patent is extended or adjusted under 35 U.S.C. 154(b) by 72 days.

(21) Appl. No.: 10/312,383

(22) PCT Filed: Jun. 26, 2001

(86) PCT No.: PCT/JP01/05476

§ 371 (c)(1),
(2), (4) Date: Jul. 31, 2003

(87) PCT Pub. No.: WO02/00523

PCT Pub. Date: Jan. 3, 2002

(65) Prior Publication Data

US 2004/0035718 A1 Feb. 26, 2004

(30) Foreign Application Priority Data

Jun. 27, 2000 (JP) ..... 2000-193110
Oct. 2, 2000 (JP) ..... 2000-302024

(51) Int. Cl.
*B65D 65/00* (2006.01)

(52) U.S. Cl. ..... 206/497; 206/264; 206/1.5; 206/807; 229/237; 229/203

(58) Field of Classification Search ..... 206/455, 206/273, 264 X, 268, 1.5, 497 X; 229/236, 229/243, 244, 237 X, 238, 87.05
See application file for complete search history.

(56) References Cited

U.S. PATENT DOCUMENTS

| | | | | |
|---|---|---|---|---|
| 2,240,539 | A * | 5/1941 | Baldwin | 206/264 |
| 2,305,428 | A * | 12/1942 | Johnson | 206/264 |
| 2,970,743 | A * | 2/1961 | Joseph et al. | 229/244 |
| 4,441,612 | A * | 4/1984 | Kingsley et al. | 229/236 |
| 5,096,113 | A * | 3/1992 | Focke | 229/87.05 |
| 5,156,270 | A * | 10/1992 | Kachel et al. | 206/451 |
| 5,201,463 | A * | 4/1993 | George | 229/203 |

FOREIGN PATENT DOCUMENTS

| | | |
|---|---|---|
| DE | 19736730 A | 2/1999 |
| JP | 7137721 A | 5/1995 |
| WO | WO 03/070601 A1 | 8/2003 |

OTHER PUBLICATIONS

JP Util. Mod. Pub. No. 50-33370, Sep. 29, 1975.

* cited by examiner

*Primary Examiner*—Jila M. Mohandesi
(74) *Attorney, Agent, or Firm*—The Webb Law Firm

(57) ABSTRACT

A packaging unit comprises a package box having an openable portion for breaking and removing a seal of a lid by a push-in operation, and a film for sealing and packing the package box, wherein the film includes a fragile portion formed in or adjacent a position corresponding to the openable portion of the package box, the fragile portion being tearable by a push-in operation on the openable portion effected from outside the film. The packaging unit provides a quick and easy seal removing operation while restraining tear and damage of the film in time of distributing and displaying products to enhance tamper-proof efficiency by sealing and packing the package box with the film through a push-in operation to be effected on the openable portion of the package box.

8 Claims, 7 Drawing Sheets

PACKAGING BODY

BACKGROUND OF THE INVENTION

1. Technical Field

The present invention relates to a packaging unit used for packing products such as drugs, foods, cosmetics and the like, and particularly to a packaging unit employing a tamper-proof technique.

2. Background Art

In the field of drugs and foods, package boxes are conventionally known which include an openable portion for breaking and removing a seal of a lid by a push-in operation. One example of such package boxes is disclosed in Utility Model Publication No. 50-33370 in which an openable and closable paper lid having an insert piece is formed integrally with an opening edge of a paper box body. Tear-aiding perforations are formed along peripheries of a wall portion of the package body overlapping the insert piece of the lid in a closed position and also joined to a predetermined position of the insert piece by an adhesive agent. These perforations define a punch-out portion that serves as an openable portion for breaking and removing the seal of the lid by a push-in operation.

This package box has one advantage that whether the package box has already been opened or not may be recognized easily based on whether or not the punch-out portion is broken along the perforations, and another advantage that the opened package box may be used as a storage case for the product since only part of the wall of the package body is broken. On the other hand, the package box is exposed outside before it is opened, and it is possible for the adhesively joined portion between the punch-out portion and the insert piece of the lid to be broken and opened with skill from outside. Thus, the conventional package unit remains unsatisfactory from the viewpoint of tamper-proofness.

It may be possible to seal and pack a package box having an openable portion as noted above with a heat shrinkable film utilizing the film packing technique disclosed in Unexamined Patent Publication No. 7-137721, for example, and to form unsealing perforations in the film beforehand.

In this case, since the openable portion of the package box cannot be tampered unless the film sealing and packing the package box is removed, the tamper-proof effect can be enhanced. However, a disadvantage of complicating an unsealing operation is caused by requiring a step of tearing the film along the perforations and a step of breaking and removing the seal of the lid by pushing in the openable portion of the package box. Further, the unsealing operation is time-consuming since this tends to involve the trouble of locating and tearing the perforations formed in part of the film.

The smaller the length of the perforations formed in the film, the less is the possibility of tearing and damaging the perforations due to an external force applied to the film in time of distributing and displaying the product. At the same time, there occurs a problem of increasing the trouble of locating the perforations when removing the seal.

SUMMARY OF THE INVENTION

The present invention has been made in view of the above-noted circumstances, and its object is to provide a packaging unit enhancing the tamper-proof effect by sealing and packing a package box with a film and further enabling the package box to be unsealed quickly and easily while restraining damage of the package box in time of distributing and displaying the product through a rational improvement utilizing a push-in operation effected on an openable portion of the package box.

A packaging unit of the present invention is characterized in that the unit comprises a package box having an openable portion for breaking and removing a seal of a lid by a push-in operation, and a film for sealing and packing said package box, wherein said film includes a fragile portion formed in or adjacent a position corresponding to said openable portion of said package box, said fragile portion being tearable by a push-in operation effected from outside said film.

With this characteristic structure, as the openable portion of the package box sealed and packed with the film is pushed in from outside the film, the push-in operation results in stress concentrating on the fragile portion formed in or adjacent the position of the film corresponding to the openable portion. Then, the film is torn along the fragile portion and concurrently the seal of the lid is broken and removed.

Further, a unique effect is produced due to the arrangement of the fragile portion formed in the limited position of the film corresponding to or adjacent the openable portion. More particularly, even when an inadvertent external force is applied to the film in time of distributing and displaying the product, tearing and damage of the fragile portion due to the inadvertent external force can be restrained, compared with the arrangement of the fragile portion formed over the entire length of the film sealing and packing the package box. Another effect of the invention is that the fragile portion is easily found since it utilizes the characteristics of the most noticeable openable portion.

As a result, not only the tamper-proof effect is enhanced by sealing and packing the package box having the openable portion with the film, but also the seal removing operation of the package box can be quickly and easily effected while restraining tear and damage of the film in time of distributing and displaying the product by a simple and inexpensive improvement of forming the fragile portion in the film in or adjacent the position corresponding to the openable portion, the fragile portion being automatically tearable by a push-in operation effected on the openable portion of the package box.

Another packaging unit of the present invention is characterized in that a tensile force is exerted on said film for facilitating tearing of the film when said openable portion is pushed in.

With this characteristic structure, the film is torn along the fragile portion as the openable portion of the package box sealed and packed with the film is pushed in from outside the film. Concurrently the tensile force exerted on the film is released to contract the film based on a torn condition. Thus, the film is not restored to the original package configuration.

Therefore, the opened condition of the film is clearly recognized, thereby to enhance the tamper-proof effect.

Another packaging unit of the present invention is characterized in that said fragile portion includes perforations formed in or adjacent a position corresponding to an edge of said openable portion which is displaced to a maximum extent when the push-in operation is effected.

With this characteristic structure, the film can be easily worked on to realize low manufacturing cost compared with other conceivable structures in which, for example, the fragile portion is formed of a thinned portion of the film. As a further advantage, the film is easily and reliably torn along the fragile portion utilizing the displacement by the push-in operation at the edge of the openable portion where an amount of the push-in operation is maximum.

Another packaging unit of the present invention is characterized in that said fragile portion includes first perforations formed in or adjacent a position corresponding to an edge of said openable portion which is displaced to a maximum extent when the push-in operation is effected, and second perforations formed in a position displaced proximally from the edge of said openable portion and extending along a direction intersecting opposite lateral edges of said openable portion.

With this characteristic structure, as the openable portion of the package box sealed and packed with the film is pushed in from outside the film, stress concentrates first on the first perforations formed in or adjacent the position of the film corresponding to the edge of the openable portion as a result of the push-in operation. Thus, the film is torn along the perforations and concurrently the sealing of the lid is broken and removed.

Subsequently, if only the first perforations are provided, a series of operations is required to pull and tear non-fragile portions, so to speak, of the film along the right and left edges of the openable portion starting from the position torn along the first perforations as a result of the push-in operation of the openable portion, and further to pull and tear the non-fragile portions of the film right and left, utilizing upper end front corners of the package box having the openable portion. This makes the opening operation of the film heavy.

However, as set forth above, the second perforations are formed in the positions of the film displaced proximally from the edge of the openable portion along the direction perpendicular to the right and left edges of the openable portion. When the film is torn along the right and left edges of the openable portion from the first perforations to the second perforations, the tear of the film is guided and formed through the second perforations toward opposite right and left ends at an upper end of the package box. As a result, an amount of operation to tear the non-fragile portions while pulling the film is reduced, thereby to enable the user to carry out the film opening operation quickly and easily with a reduced force.

Another packaging unit of the present invention is characterized in that said fragile portion formed in said film has a length equal or approximate to a width of said openable portion of the package box.

With this characteristic structure, it is possible to more effectively restrain tear and damage of the fragile portion even when an inadvertent external force is applied to the film in time of distributing and displaying the product, compared with the structure in which the fragile portion has a length smaller than the width of the package box and larger than the width of the openable portion.

Another packaging unit of the present invention is characterized in that indication prints for a push-in operation are provided on said film in or adjacent the position where said fragile portion is formed and on said openable portion of said package body, respectively.

With this characteristic structure, since these indication prints visually guide a thumb or finger of the user attempting to remove the sealing of the package box to the proper push-in position, the push-in operation may be carried out easily and reliably without bafflement.

Another packaging unit of the present invention is characterized in that said openable portion of said package box comprises a punch-out portion consisting of part of a package body overlapping an insert piece of said lid in a closed position, said punch-out portion having a portion adhered to said insert piece and defined by tear-aiding perforations.

With this characteristic structure, as a push-in operation is effected on the punch-out portion, the punch-out portion is torn and separated from the package body along the perforations and then the separated punch-out portion is opened in union with the insert piece of the lid.

Thus, since the punch-out portion to be torn and separated as the openable portion consists of part of the package body, the length of the fragile portion formed in or adjacent the position of the film corresponding to the punch-out portion is also reduced, thereby to restrain an inadvertent tear and damage of the film in time of distributing and displaying the product.

Another packaging unit of the present invention is characterized in that the film comprises a heat shrinkable film.

With this characteristic structure, a tensile force is readily applied to the film for sealing and packing the package box by utilizing the heat shrinkability to facilitate tearing of the film when a push-in operation is effected on the openable portion. As a result, a low packaging cost can be realized.

Another packaging unit of the present invention is characterized in that said second perforations are formed in a right and left pair to traverse the lateral edges of said openable portion, respectively, and wherein each of said second perforations extends to protrude laterally outwardly of an end of said first perforations.

With this characteristic structure, as a push-in operation is effected from outside the film on the openable portion of the package box sealed and packed with the film, tears of the film are guided and formed through the second perforations toward opposite lateral edges of the upper end of the package box when the film is torn from the first perforations to the second perforations along the lateral edges of the openable portion with the push-in operation. In this condition, the right and left pair of second perforations extend to protrude laterally outwardly of the ends of the first of perforations, respectively, and the tears are smoothly guided and formed from the second perforations toward the opposite lateral edges at the upper end of the package box, thereby to enable the film opening operation to be carried out quickly and easily with a reduced force.

BRIEF DESCRIPTION OF THE DRAWINGS

FIG. 11 is a perspective view showing a condition in which a heat shrinkable film is torn when a punch-out portion is pushed in;

DETAILED DESCRIPTION OF THE INVENTION

The present invention will be described in detail hereinafter with reference to the accompanying drawings.

FIRST EMBODIMENT

FIGS. 1 through 5 show a packaging unit for receiving a product A such as an eyedropper, the packaging unit including a paper package box 1 having an openable portion 1D for breaking and removing a seal of a lid 1B by a push-in operation, and a film 2 for sealing and packing entire surfaces of the package box 1. The film 2 defines a fragile portion 3 in or adjacent a position corresponding to the openable portion 1D of the package box 1, which is tearable by a push-in operation effected on the openable portion 1D from outside the film 2.

Figure 1:
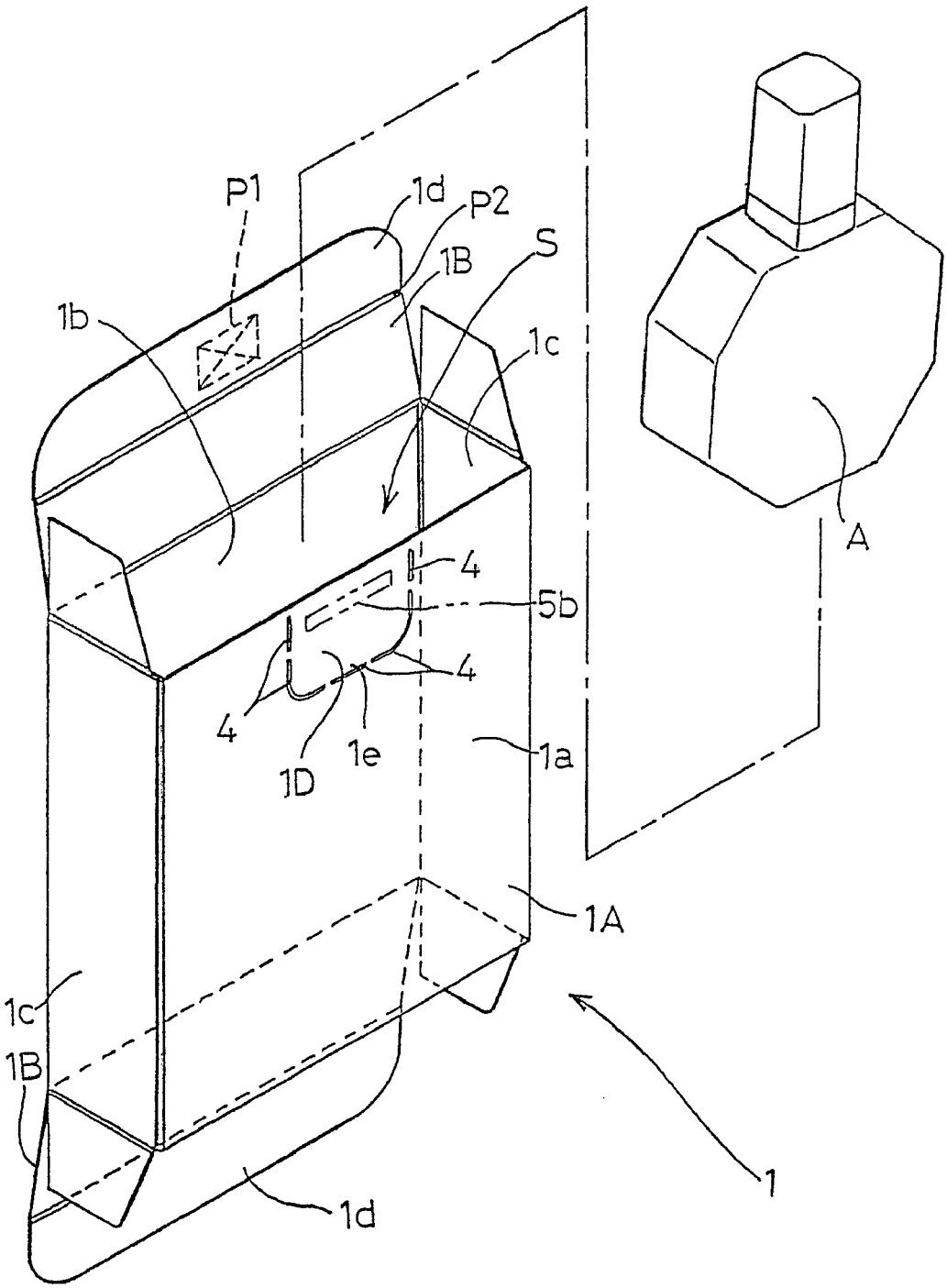
FIG. 1 is a perspective view showing an opened condition of a package box used in a first embodiment of a packaging unit according to the present invention and a product placed therein.

More particularly, as shown in FIG. 1, the package box 1 comprises a quadrangle tubular box body 1A consisting of a pair of front and back sidepieces 1*a* and 1*b* and a pair of right and left sidepieces 1*c* to define a storage space S for receiving the product A, and lids 1B formed integrally with vertically (axially of the tube) opposite ends of the back sidepiece 1*b*, respectively, for freely opening and closing two openings of the package body 1A. Each lid 1B has an insert piece 1*d* for maintaining a closed position.

Further, the package body 1A has tear-aiding perforations 4 formed in part of an area thereof overlapping the insert piece 1*d* of the lid 1B in the position for closing the opening which allows access to the product A. More particularly, the tear-aiding perforations 4 are formed in the front sidepiece 1*a* of the package body 1A, and along peripheries of a rectangular section applied by an adhesive to a particular portion P1 at a transversely middle of the insert piece 1*d*. This rectangular section (also referred to as a punch-out portion) defined by the perforations 4 comprises the openable portion 1D broken and removed along the perforations 4 through a push-in operation by a thumb or finger of the user attempting to unseal the lid 1B.

The film 2 comprises a heat shrinkable synthetic resin film 2 used in common shrink packaging. By way of example, a biaxially oriented film made of polyethylene, polypropylene, vinyl chloride, ethylene-vinyl acetate copolymer or the like may be used.

Figure 2:
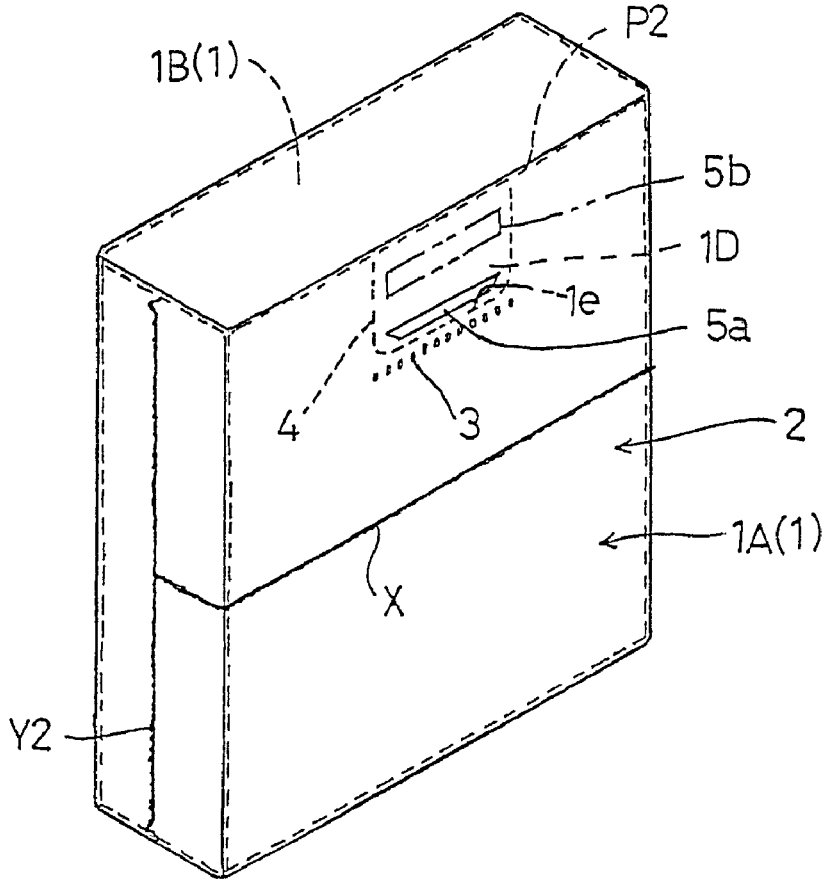
FIG. 2 is a perspective view of the packaging unit of the present invention after shrink packaging.
Figure 3:
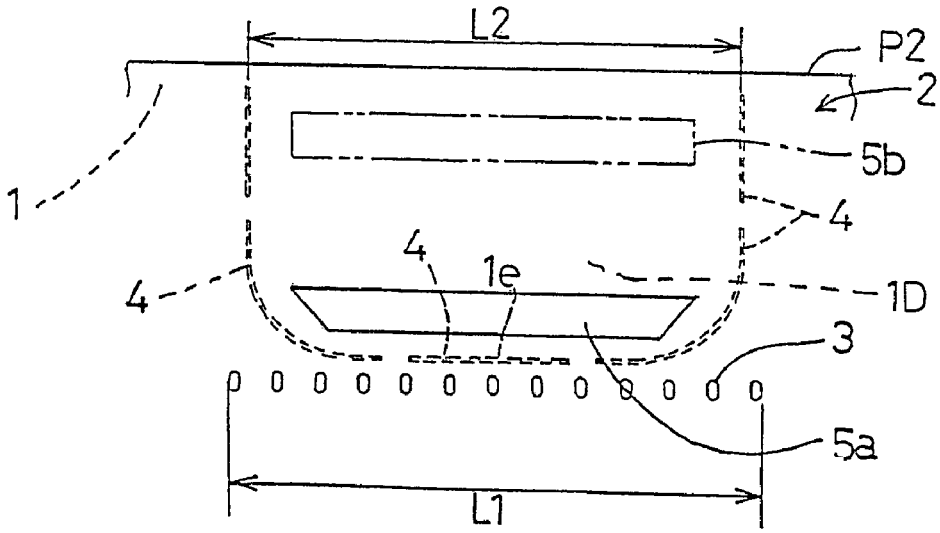
FIG. 3 is an enlarged front view of a principal portion of the packaging unit after shrink packaging.

As shown in FIGS. 2 and 3, the heat shrinkable film 2 includes perforations constituting the fragile portion 3 formed in a position adjacent and outwardly of an edge 1*e* of the punch-out portion 1D and linearly parallel or substantially parallel to the edge 1*e* of the punch-out portion 1D which is displaced to a maximum extent in time of a push-in operation, i.e. a deep end edge 1*e* remotest from a boundary P2 between the lid 1B and the insert piece 1*d*. The perforations 3 formed in the heat shrinkable film 2 has a length (fragile length) L1 slightly larger than a width L2 of the punch-out portion 1D of the package box 1.

The heat shrinkable film 2 is heat-sealed at all seams which are joined with the entire surfaces of the package box 1 covered with the film. The entire surfaces of the package box 1 are sealed and packed tight by shrinking action of the heat shrinkable film 2 occurring with heat treatment in time of heat sealing or heat treatment after the heat sealing. Concurrently, a tensile force is applied to the heat shrinkable film 2 sealing and packing the package box 1 for facilitating tear of the film 2 when the punch-out portion 1D is pushed in.

Figure 4:
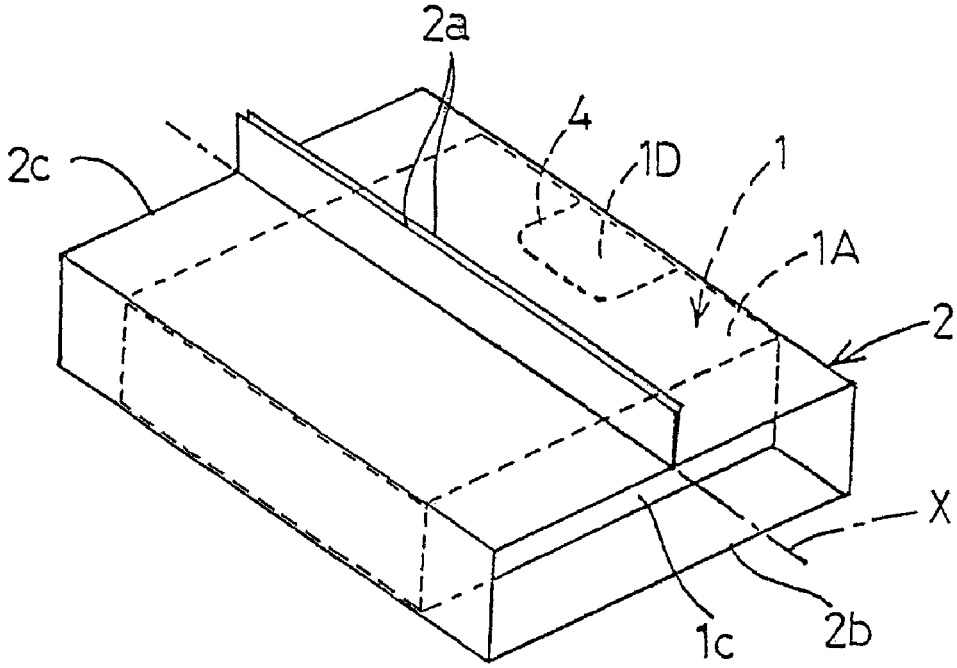
FIG. 4 is a perspective view showing a first heat sealing step of shrink packaging.
Figure 5:
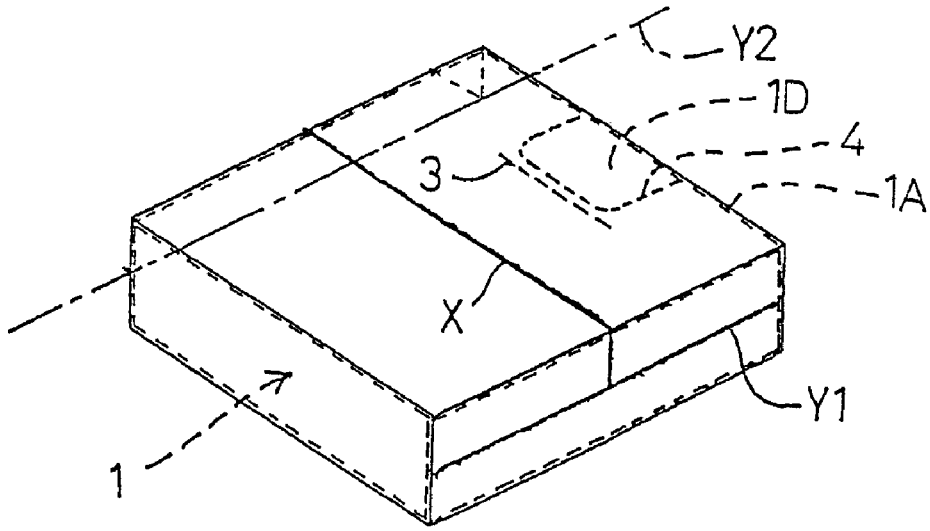
FIG. 5 is a perspective view showing a third heat sealing step of shrink packaging.

The first embodiment employs a three-way sealing method. More particularly, as shown in FIG. 4, seams 2*a* of the heat shrinkable film 2 folded along the forward side (front), right and left lateral sides and rear side (back) of the package box 1 are heat-sealed along a first sealing line X. Then, hot air is blown to thermally contract the heat shrinkable film 2. Further, as shown in FIG. 5, right and left film portions 2*b* and 2*c* protruding outwardly are heat-sealed along a second sealing line Y1 and a third sealing line Y2, thereby to pack the package box 1 with the heat shrinkable film 2.

In a position adjacent the perforations 3 of the heat shrinkable film 2 and in the punch-out portion 1D of the package box 1 are provided indication prints 5*a* and 5*b* of marks and characters as a visual guide to the position to be pushed in.

SECOND EMBODIMENT

Figure 6:
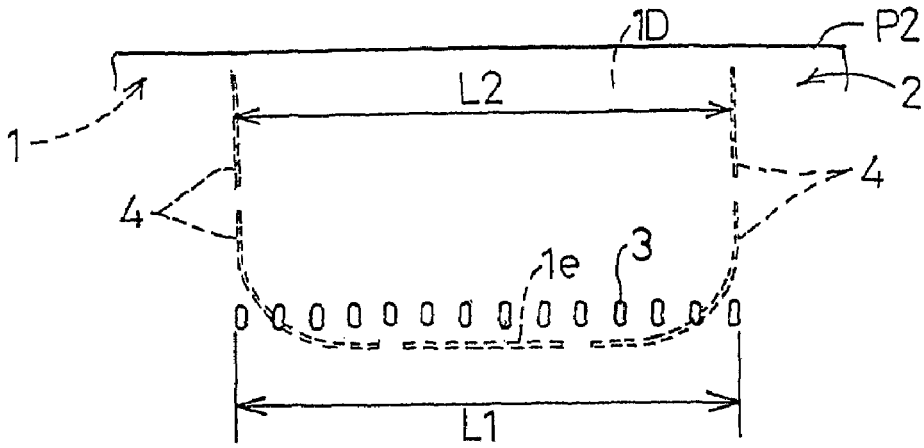
FIG. 6 is an enlarged front view of a principal portion of a packaging unit according to a second embodiment of the present invention after shrink packaging.

In a packaging unit according to a second embodiment of the present invention, as shown in FIG. 6, a heat shrinkable film 2 includes perforations constituting a fragile portion 3 perforations formed in a position corresponding to an edge 1*e* of a punch-out portion 1D and linearly parallel or substantially parallel to the edge 1*e* of the punch-out portion 1D which is displaced to a maximum extent in time of a push-in operation, i.e. a deep end edge 1*e* remotest from a boundary P2 between a lid 1B and an insert piece 1*d*. The perforations 3 formed in the heat shrinkable film 2 has the same or substantially the same length L1 as a width L2 of the punch-out portion 1D of the package box 1.

The other aspects of the construction are the same as in the first embodiment, and like reference numbers are affixed to like elements in the first embodiment and will not be described here.

THIRD EMBODIMENT

Figure 7:
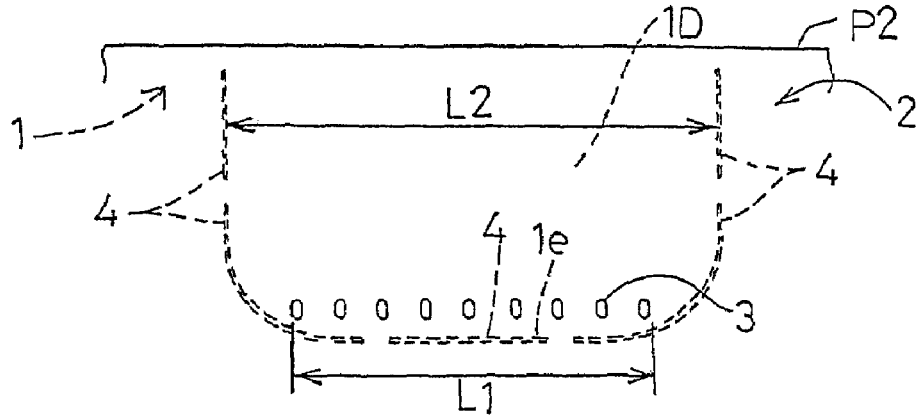
FIG. 7 is an enlarged front view of a principal portion of a packaging unit according to a third embodiment of the present invention after shrink packaging.

In a packaging unit according to a third embodiment of the present invention, as shown in FIG. 7, a heat shrinkable film 2 includes perforations constituting a fragile portion 3 formed in a position adjacent and inwardly of an edge 1*e* of a punch-out portion 1D and linearly parallel or substantially parallel to the edge 1*e* of the punch-out portion 1D which is displaced to a maximum extent in time of a push-in operation, i.e. a deep end edge 1*e* remotest from a boundary P2 between a lid 1B and an insert piece 1*d*. The perforations 3 formed in the heat shrinkable film 2 has a length L1 slightly smaller than a width L2 of the punch-out portion 1D of the package box 1.

The other aspects of the construction are the same as in the first embodiment, and like reference numbers are affixed to like elements in the first embodiment and will not be described here.

FOURTH EMBODIMENT

Figure 8:
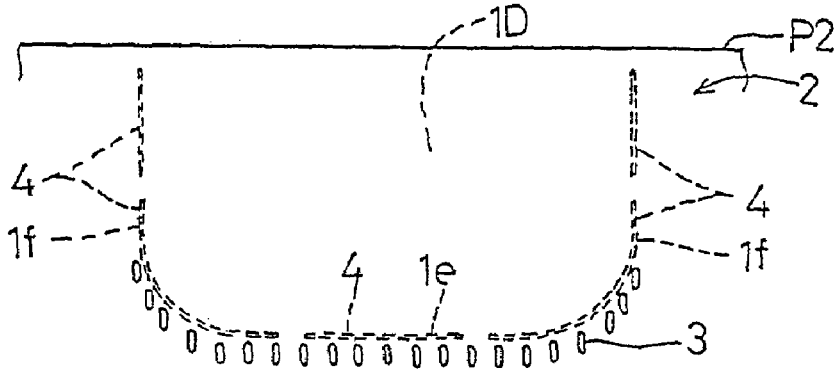
FIG. 8 is an enlarged front view of a principal portion of a packaging unit according to a fourth embodiment of the present invention after shrink packaging.

In a packaging unit according to a fourth embodiment of the present invention, as shown in FIG. 8, a heat shrinkable film 2 includes perforations constituting a fragile portion 3 formed in a position adjacent and outwardly of a deep end edge 1*e* of a punch-out portion 1D and in a U-shaped line along the edge 1*e* and parts of right and left edges 1*f* continuing therefrom of the punch-out portion 1D, the deep edge 1*e* of the punch-out portion 1D being displaced to a maximum extent in time of a push-in operation.

The other aspects of the construction are the same as in the first embodiment, and like reference numbers are affixed to like elements in the first embodiment and will not be described here.

FIFTH EMBODIMENT

Figure 9:
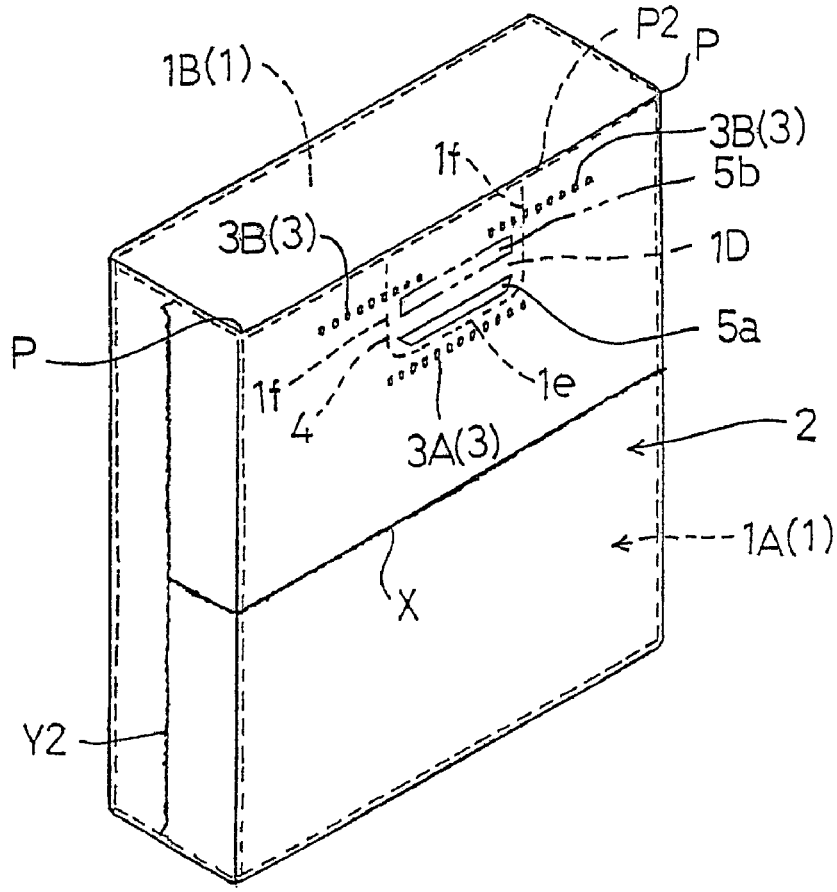
FIG. 9 is a perspective view of a packaging unit according to a fifth embodiment of the present invention after shrink packaging.
Figure 10:
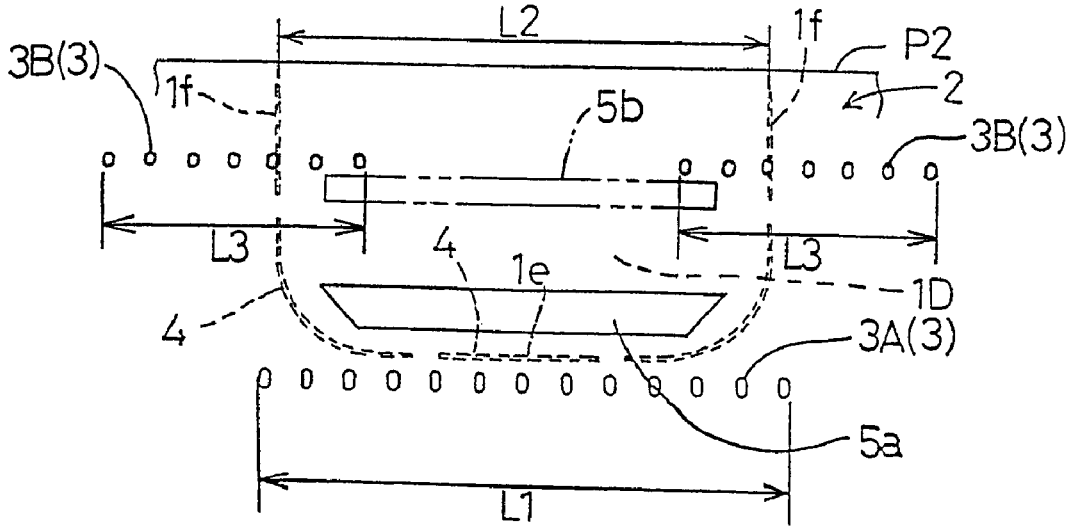
FIG. 10 is an enlarged front view of a principal of the packaging unit as shown in FIG. 9.
Figure 11:
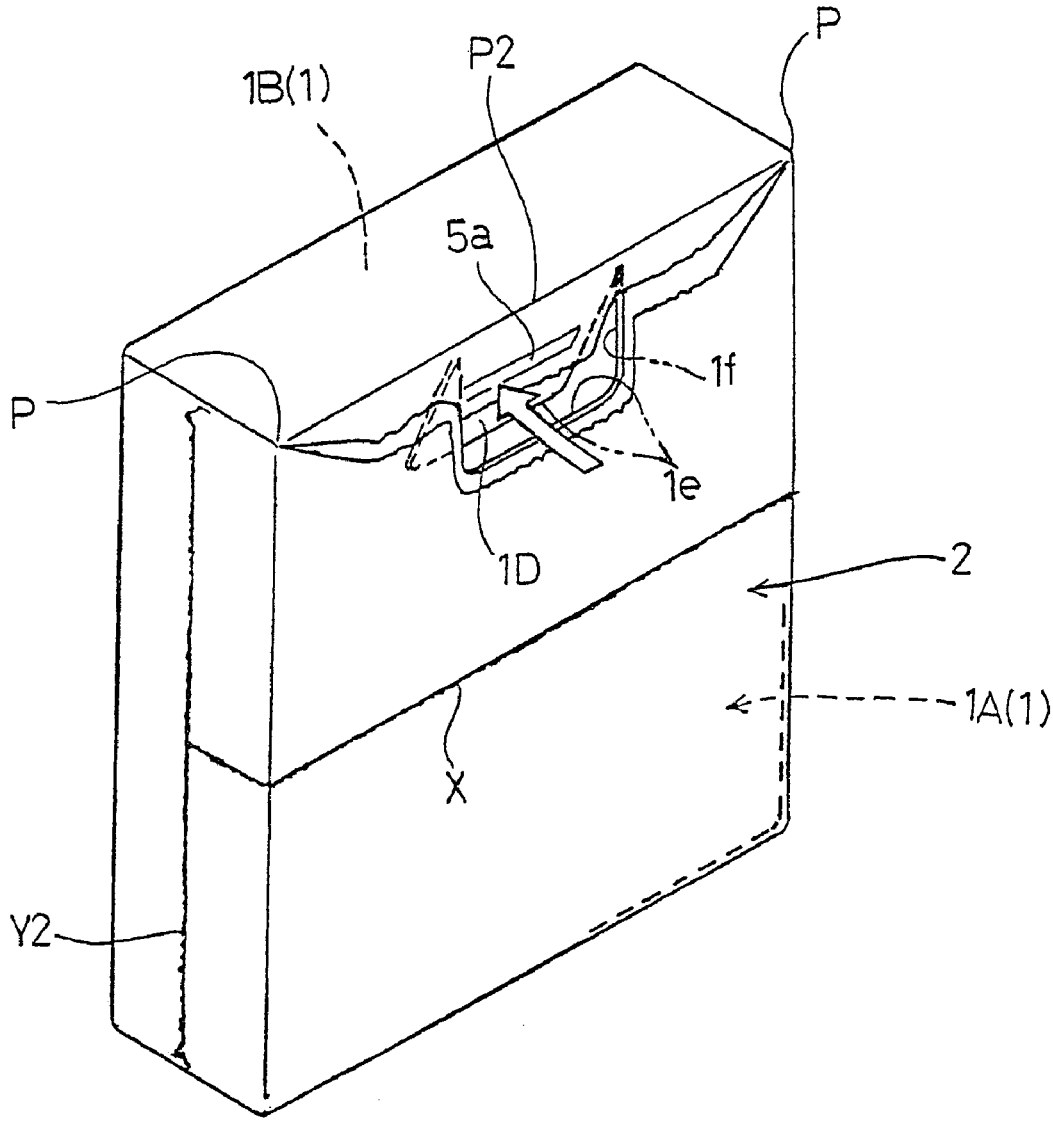
Figure 12:
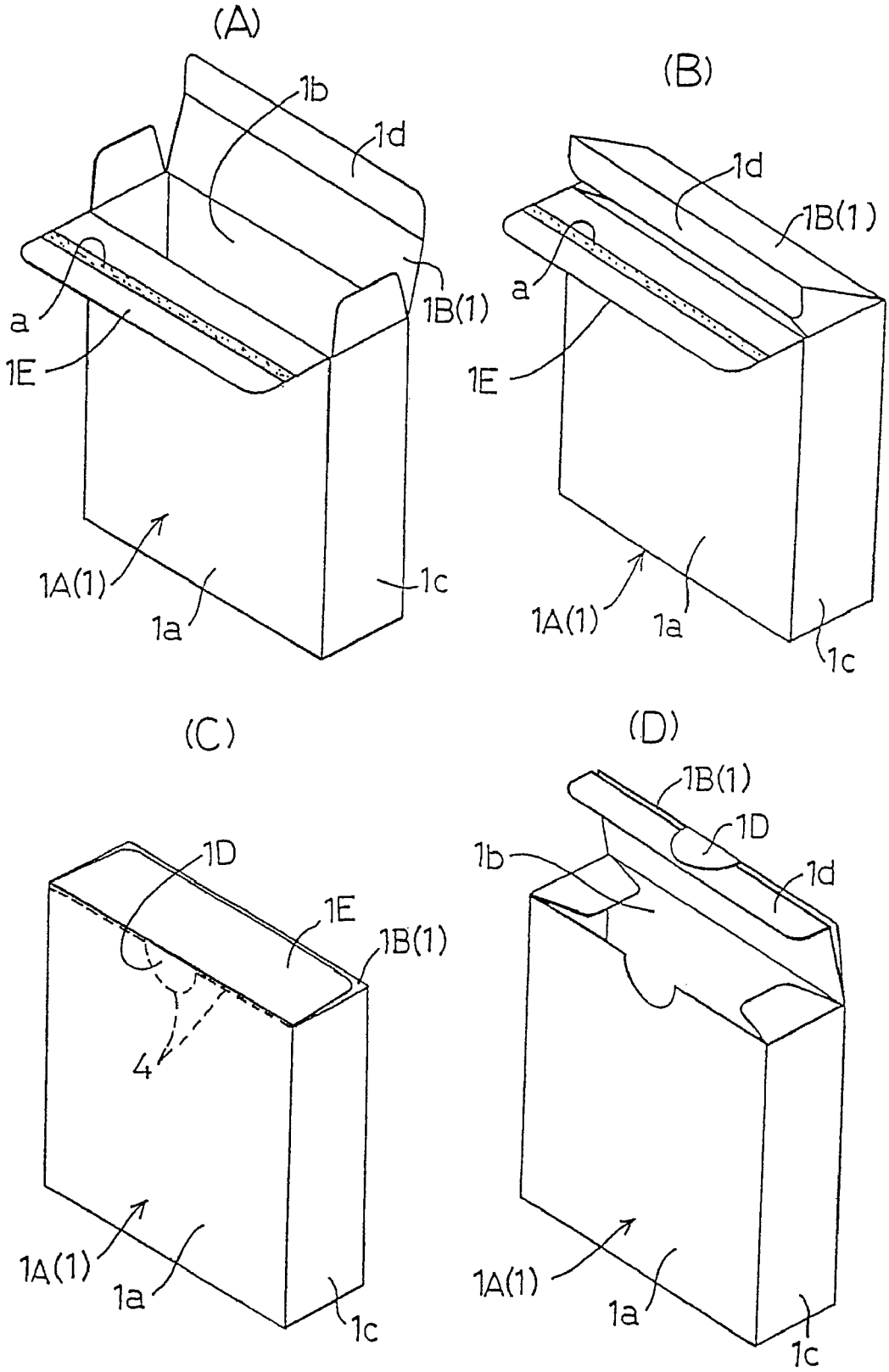
FIG. 12(A) is a perspective view of a package box before assembly thereof according to a sixth embodiment of the present invention.
FIG. 12(B) is a perspective view of the package box in the course of assembly according to the sixth embodiment of the present invention.
FIG. 12(C) is a perspective view of the package box after the assembly thereof is completed according to the sixth embodiment of the present invention.
FIG. 12(D) is a perspective view of the package box when a seal thereof is broken and removed according to the sixth embodiment of the present invention.

In a packaging unit according to a fifth embodiment of the present invention, as shown in FIGS. 9 through 11, a heat shrinkable film 2 includes first perforations 3A constituting part of a fragile portion 3 formed in a position adjacent and outwardly of an edge 1*e* of the punch-out portion 1D and linearly parallel or substantially parallel to the edge 1*e* of the punch-out portion 1D which is displaced to a maximum extent in time of a push-in operation, i.e. a deep end edge 1*e* remotest from a boundary P2 between a lid 1B and an insert piece 1*d*. In addition to the first perforations 3A, a pair of right and left second perforations 3B are formed as part of the fragile portion 3 in intermediate positions of the heat shrinkable film 2 displaced proximally from the edge 1*e* of the punch-out portion 1D and traversing right and left edges 1*f* of the punch-out portion 1D to extend along a direction perpendicular (crosswise) to the right and left edges 1*f*, respectively.

The first perforations 3A formed in the heat shrinkable film 2 has a length (fragile length) L1 slightly larger than a width L2 of the punch-out portion 1D of the package box 1, while the second perforations 3B extend further laterally outwardly than opposite ends of the first perforations 3A.

In this embodiment, when the package box 1 is 79 mm in height, 68 mm in width and 20 mm in depth, the punch-out portion 1D is 15 mm in height and 22 mm in width L2, the first perforations 3A are 25 mm in length L1, and the second perforations 3B are 15 mm in length L3, respectively.

As the punch-out portion D1 of the package box 1 sealed and packed with the heat shrinkable film 2 is pushed in from outside the heat shrinkable film 2, stress concentrates on the first perforations 3A formed in the heat shrinkable film 2 in or adjacent the position corresponding to the deep end edge 1*e* of the punch-out portion 1D as a result of the push-in operation. Thus, the heat shrinkable film 2 is torn along the first perforations 3A and concurrently the sealing of the lid 1B is broken.

In this state, if only the first perforations 3A are provided, a series of operations is required to pull and tear non-fragile portions, so to speak, of the heat shrinkable film 2 along the right and left edges 1*f* of the punch-out portion 1D starting from the position torn along the first perforations 3A as a result of the push-in operation of the punch-out portion 1D, and further to pull and tear the non-fragile portions of the heat shrinkable film 2 right and left, utilizing upper end front corners (corners corresponding to the boundary P2 between the lid 1B and the insert piece 1*d*) of the package box 1 having the punch-out portion 1D in order to freely open and close the lid 1B. This makes the opening operation of the heat shrinkable film 2 heavy.

However, in the fifth embodiment, the pair of right and left second perforations 3B are formed in the intermediate positions of the heat shrinkable film 2 displaced proximally from the edge 1*e* of the punch-out portion 1D (toward the boundary P2 between the lid 1B and the insert piece 1*d*) along the direction perpendicular to the right and left edges 1*f* of the punch-out portion 1D. When the film is torn along the right and left edges 1 of the punch-out portion 1D from the first perforations 3A to the right and left second perforations 3B, as shown in FIG. 11, the tear of the heat shrinkable film 2 is guided and formed obliquely upward through the second perforations 3B toward opposite right and left ends (shoulder portions) P at an upper end of the package box 1. This reduces an amount of operation to tear the non-fragile portions which must be done while pulling the heat shrinkable film 2, thereby to enable the user to carry out the opening operation of the heat shrinkable film 2 quickly and easily with a reduced force.

The other aspects of the construction are the same as in the first embodiment, and like reference numbers are affixed to like elements in the first embodiment and will not be described.

SIXTH EMBODIMENT

In a packaging unit according to a sixth embodiment of the present invention, as shown in FIGS. 12(A) through 12(D), a package box 1 includes a back sidepiece 1*b* integrally formed at an end portion thereof with a lid 1B for freely opening and closing an opening of a package body 1A, the lid having an insert piece 1*d* for maintaining a closed position. A front sidepiece 1*a* is integrally formed at an end portion thereof with an auxiliary lid 1E lying over the lid 1B assuming the closed position. On an inner surface of the auxiliary lid 1E is applied an adhesive agent (glue) "a" for sticking the auxiliary lid 1E to the upper surface of the lid 1B. Further, tear-aiding perforations 4 are formed basically along a boundary between the auxiliary lid 1E and front sidepiece 1*a*, and curved in a U-shaped line or in an arc in a transversely middle position of the front sidepiece 1*a* overlapping the insert piece 1*d* of the lid 1B. A punch-out portion D1 defined by the perforations 4 comprises an unsealing portion for breaking and removing the sealing of the lid 1B along the perforations 4 by a push-in operation.

The other aspects of the construction are the same as in the first embodiment, and like reference numbers are affixed to like elements in the first embodiment and will not be described.

OTHER EMBODIMENTS (1) The package box 1 of any structure may be used as long as it includes the openable portion 1D for breaking and removing the sealing of the lid 1B by a push-in operation.

(2) According to the foregoing embodiments, the fragile portion 3 is in the form of perforations. Instead, it may be a thin wall portion formed in a line or intermittent line having a reduced thickness compared with the other parts.

In the fifth embodiment noted above, the pair of right and left second perforations 3B constituting parts of the fragile portion 3 are formed in one intermediate position displaced proximally from the edge 1*e* of the punch-out portion 1D.

Instead, these perforations 3B may be formed in a plurality of intermediate positions displaced proximally from the edge 1*e* of the punch-out portion 1D. Also, the second perforations 3B may be formed zigzag.

Further, in the fifth embodiment noted above, the right and left second perforations 3B constituting parts of the fragile portion 3 are formed along the direction perpendicular to the right and left edges 1*f* of the punch-out portion 1D. Instead, the second perforations 3B may be formed in slanting positions (crossing positions) to extend toward the opposite lateral edges (shoulder portions) at the upper end of the package box 1.

In sum, the fragile portion 3 of any configuration may be employed as long as it is tearable by pressing the openable portion 1D from outside the film 2.

(3) In the foregoing embodiments, heat shrinkable film used in common shrink packaging is employed. Instead, any types of film other than heat shrinkable film may be used.

In this case also, the entire surfaces of the package box 1 may be sealed and packed with a tensile force being exerted on the film 2 in order for the tensile force to be applied for facilitating tear of the film 2 when the punch-out portion 1D is pushed in.

(4) The fragile portion 3 of the film 2 may be formed in any desired configuration and size in or adjacent the position corresponding to the openable portion 1D as long as it is tearable by a push-in operation made on the openable portion 1D from outside the film 2.

(5) In the foregoing embodiments, the belt-like heat shrinkable film 2 encloses the entire surfaces of the package box 1 and is heat-sealed at three sides thereof to seal and pack the box. Instead, any heat-sealing method may be employed as long as mating seams of the heat shrinkable film 2 are all heat-sealed.

INDUSTRIAL UTILITY

As described above, the packaging unit relating to the present invention is suitable for use as a packaging unit having a tamper-proof effect, specifically as a packaging unit for packing products such as drugs, foods, cosmetics and the like.

The invention claimed is:

1. A packaging unit, comprising a package box having:

an openable portion for breaking and removing a seal of a lid by a push-in operation, and a film for sealing and packing said package box, wherein said film includes a fragile portion formed in or adjacent a position corresponding to said openable portion of said package box, said fragile portion being tearable by the push-in operation effected on said openable portion from outside said film, and wherein said openable portion of said package box comprises a punch-out portion consisting of a part of the package body overlapping an insert piece of said lid in a closed position, said punch-out portion having a portion adhered to said insert piece and defined by tear-aiding perforations.

2. The packaging unit as defined in claim 1, wherein a tensile force is exerted on said film for facilitating tearing of the film when said openable portion is pushed in.

3. The packaging unit as defined in claim 1, wherein said fragile portion includes perforations formed in or adjacent a position corresponding to an edge of said openable portion, said edge is displaced to a maximum extent when the push-in operation is effected.

4. The packaging unit as defined in claim 1, wherein said fragile portion includes first perforations formed in or adjacent a position corresponding to an edge of said openable portion, said edge is displaced to a maximum extent when the push-in operation is effected, and second perforations formed in a position displaced proximally from the edge of said openable portion and extending along a direction intersecting opposite lateral edges of said openable portion.

5. The packaging unit as defined in claim 4, wherein said second perforations are formed in a right and left pair to traverse the lateral edges of said openable portion and wherein each of said second perforations extends to protrude laterally outwardly of an end of said first perforations.

6. The packaging unit as defined in claim 1, wherein said fragile portion formed in said film has a length equal or approximate to a width of said openable portion of the package box.

7. The packaging unit as defined in claim 1, wherein indication prints for the push-in operation are provided on said film in or adjacent the position where said fragile portion is formed and on said openable portion of said package body.

8. The packaging unit as defined in claim 1, wherein said film comprises a heat shrinkable film.

* * * * *